US005813781A

United States Patent [19]

Harris et al.

[11] Patent Number: 5,813,781

[45] Date of Patent: Sep. 29, 1998

[54] DOCUMENT FEED ROLLER OPENER AND METHOD THEREFOR

[75] Inventors: Richard Hunter Harris; Jeff David Thomas; Kevin Hunter Vorhees, all of Raleigh, N.C.

[73] Assignee: International Business Machines Corporation, Armonk, N.Y.

[21] Appl. No.: 781,770

[22] Filed: Jan. 10, 1997

[51] Int. Cl.[6] ..... B41J 13/02

[52] U.S. Cl. ..... 400/636; 400/637.1

[58] Field of Search ..... 400/636, 636.1, 400/637, 637.1, 637.6, 639

[56] References Cited

U.S. PATENT DOCUMENTS

| | | | |
|---|---|---|---|
| 4,205,770 | 6/1980 | Wojdyla | 400/608.1 |
| 4,275,969 | 6/1981 | Matsuhisa et al. | 400/639.1 |
| 4,437,780 | 3/1984 | Weber et al. . | |
| 4,448,559 | 5/1984 | Matsuda et al. | 400/637.1 |
| 4,518,271 | 5/1985 | Hirata . | |
| 4,560,295 | 12/1985 | Fujiwara et al. | 400/637.1 |
| 4,602,883 | 7/1986 | Ozawa et al. | 400/637.1 |
| 4,641,830 | 2/1987 | Okuda et al. | 400/637.1 |
| 4,655,626 | 4/1987 | Okazaki | 400/639.1 |
| 4,688,958 | 8/1987 | Tajima | 400/637.1 |
| 4,693,621 | 9/1987 | Kawaguchi | 400/636.1 |
| 4,832,519 | 5/1989 | Fujimoto | 400/639.1 |
| 4,859,099 | 8/1989 | Kanemoto et al. . | |
| 4,884,085 | 11/1989 | Ozawa | 400/637.1 |
| 5,007,752 | 4/1991 | Yasumi et al. | 400/636 |
| 5,135,321 | 8/1992 | Olsen et al. . | |
| 5,209,590 | 5/1993 | Tsukuda et al. . | |
| 5,468,079 | 11/1995 | Murakoshi et al. . | |
| 5,558,451 | 9/1996 | Hanabusa et al. | 400/637 |

*Primary Examiner*—Eugene H. Eickholt
*Attorney, Agent, or Firm*—John D. Flynn; Winstead Sechrest & Minick

[57] ABSTRACT

A document feed roller opening mechanism and a method for operating that opener provide efficient and reliable operation. In the document feed roller opening mechanism, a print head transport motor is used to open the document feed rollers. A carrier post is implemented to engage a document insert lever when the print head carrier is positioned over a cam on the document insert lever. Thus engaged, the document insert lever rotates to pull a left end of the document insert pressure roller. The left end of the document insert pressure roller slides towards a front of the printer and a right end pivots slightly in a right frame. A spring implemented therein compresses as the document insert pressure roller moves away from a stationary document insert feed roller. This spring provides pressure to the document insert feed roller when the rollers are together. With the document insert feed rollers open, one may easily slide a document in from the side of the printer.

22 Claims, 5 Drawing Sheets

ISOMETRIC VIEW OF TRANSPORT MECHANISM 100
FIGURE 1

DOCUMENT FEED ROLLER OPENER AND METHOD THEREFOR

CROSS-REFERENCE TO RELATED APPLICATIONS

Related subject matter may be found in the following commonly assigned, co-pending U.S. patent applications, both of which are hereby incorporated by reference herein:

(1) Ser. No. 08/781,771, entitled "Check Flipper for Point of Sale Printer and Method Therefor" by Richard H. Harris, et al. (Attorney Docket No. RA9-96-063), which is filed concurrently herewith; and (2) Ser. No. 08/781,633, entitled "Curvilinear Pressure Pad for Improved MICR Reading and Method Therefor" by Robert A. Myers (Attorney Docket No. RA9-96-084), which is also filed concurrently herewith.

TECHNICAL FIELD

The present invention relates in general to a printer and, more particularly, to a feed roller opener in a printer.

BACKGROUND INFORMATION

Document printing and point of sale printers are becoming common place. To insert documents into point of sale printers, the document is typically inserted through a document throat that is opened in a side or front of the printer. During operation, document feed rollers included within the printer must be separated so that the document can be inserted therein from the side. Typically, a dedicated solenoid is used to separate the document feed roller so that the document may be inserted. However, such a dedicated solenoid is often expensive and is a relatively unreliable solution.

Several prior art techniques have attempted to implement improved document feed mechanisms which are more reliable and less expensive. For example, in U.S. Pat. No. 4,518,271, by Yoshikatsu Hirata, a mechanism for opening a paper holding device therein is implemented. In the printer described in the aforementioned patent, an actuating means opens the paper holding device when a printer carriage is moved to one side out of the printing region. The open position of a paper holding device is formed when a pressure roller is fully removed from a paper or platen of the printer. The invention disclosed in U.S. Pat. No. 4,518,271 provides a method for opening and closing paper holding devices in a printer. However, the methodology implemented therein requires several levers and mechanical devices which may be susceptible to mechanical failures. Additionally, the pressure roller must be fully removed from the platen for the device to operate as disclosed therein. The use of additional mechanical components, as well as the complete removal of the paper holding device from the platen, results in a printer paper holding device opener which is not optimal and which remains a somewhat unreliable solution.

Therefore, there remains a need for an inexpensive and reliable solution to a problem associated with opening printers to insert a document.

SUMMARY OF THE INVENTION

The previously mentioned needs are fulfilled with the present invention. Accordingly, there is provided, in one form, a document feed roller. The document feed roller includes a print head carrier having a print head carrier post. The document feed roller also includes a document insert lever having a first end and a second end. The document insert lever has a cam at the second end and the print head carrier post engages the cam to rotate the document insert lever in a first direction. The document feed roller includes a device having a first end connected to the first end of the document insert lever and a second end. The document feed roller also includes a document insert feed roller having a first end and a second end. The first end and the second end of the document insert feed roller are in a first fixed position. A pressure roller is also included which has a first end and a second end. The first end of the pressure roller is in a second fixed position and the second end of the pressure roller is connected to the second end of the device. The second end of the pressure roller is moved away from the second end of the document insert feed roller when the print head carrier post engages the cam to rotate the document insert lever in the first direction.

Additionally, there is provided, in a second form, a method for opening a document feed roller. The method includes the steps of providing a print head carrier having a print head carrier post and engaging a cam at a second end of a document insert lever with the print head carrier post. The method also includes the steps of rotating the document insert lever in a first direction, affixing a first end and a second end of a document insert feed roller in a first fixed position, affixing a first end of a pressure roller and a second fixed position, and moving a second end of the pressure roller away from a second end of the document insert feed roller when the document insert lever is rotated in the first direction.

Furthermore, there is provided, in a third form, a point of sale printer. The point of sale printer includes a platen and a print head carrier comprising a print head and a print head carrier post, wherein the print head carrier moves parallel to the platen. The point of sale printer also includes a document insert feed roller having a first end and a second end. The first end and the second end of the document insert feed roller are in a first fixed position. The point of sale printer includes a document insert lever having a first end and a second end. The document insert lever has a cam at the second end. The print head carrier post engages the cam to rotate the document insert lever in a first direction. A first end of a spring is connected to the first end of the document insert lever. The spring also has a second end. The point of sale printer also includes a pressure roller having a first end and a second end. The first end of the pressure roller is in the second fixed position and the second end of the pressure roller is connected to the first end of the spring. The second end of the pressure roller is moved away from the second end of the document insert feed roller when the print head carrier post engages the cam to rotate the document insert lever in a first direction. The first end of the pressure roller remains in the second fixed position when the second end of the pressure roller is moved away.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
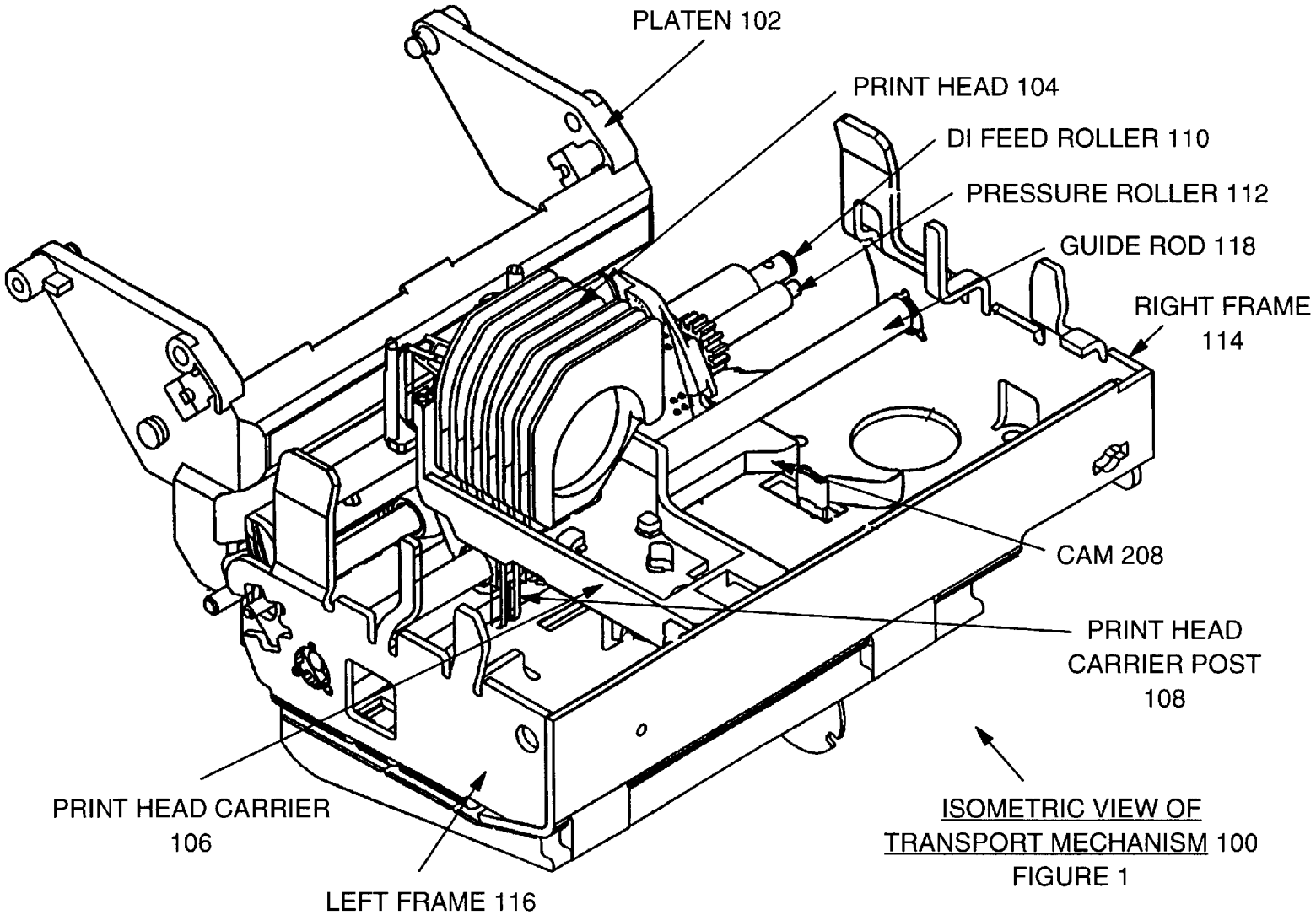
FIG. 1 illustrates a view of a transport mechanism of a printer.

The present invention implements a document feed roller opening mechanism and a method for operating that opener which provides for a more efficient and reliable operation. In the present invention, a print head transport motor is used to open the document feed rollers. A carrier post is implemented to engage a document insert lever when the print head carrier is positioned over a cam on the document insert lever. It should be noted that this will happen when the print head carrier is positioned outside a normal print zone. Thus engaged, the document insert lever rotates to pull a left end of the document insert pressure roller. The left end of the document insert pressure roller slides towards a front of the printer and a right end pivots slightly in a right frame. A spring implemented therein compresses as the document insert pressure roller moves away from a stationary document insert feed roller. This spring provides pressure to the document insert feed roller when the rollers are together. With the document insert feed rollers open, one may easily slide a document in from the side of the printer. It should be noted that only one end of the document insert pressure roller is moved away from the document insert feed roller. The other end of the document insert pressure roller and the stationary document insert feed roller remain in relevant contact with the frame of the printer. Thus, the present invention provides a reliable and inexpensive solution to perform a document feed roller opening operation. Operation of the present invention will subsequently be described in greater detail.

In the following description, numerous specific details are set forth to provide a thorough understanding of the present invention. However, it will be obvious to those skilled in the art that the present invention may be practiced without such specific details. For the most part, details concerning timing considerations and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views.

Figure 5:
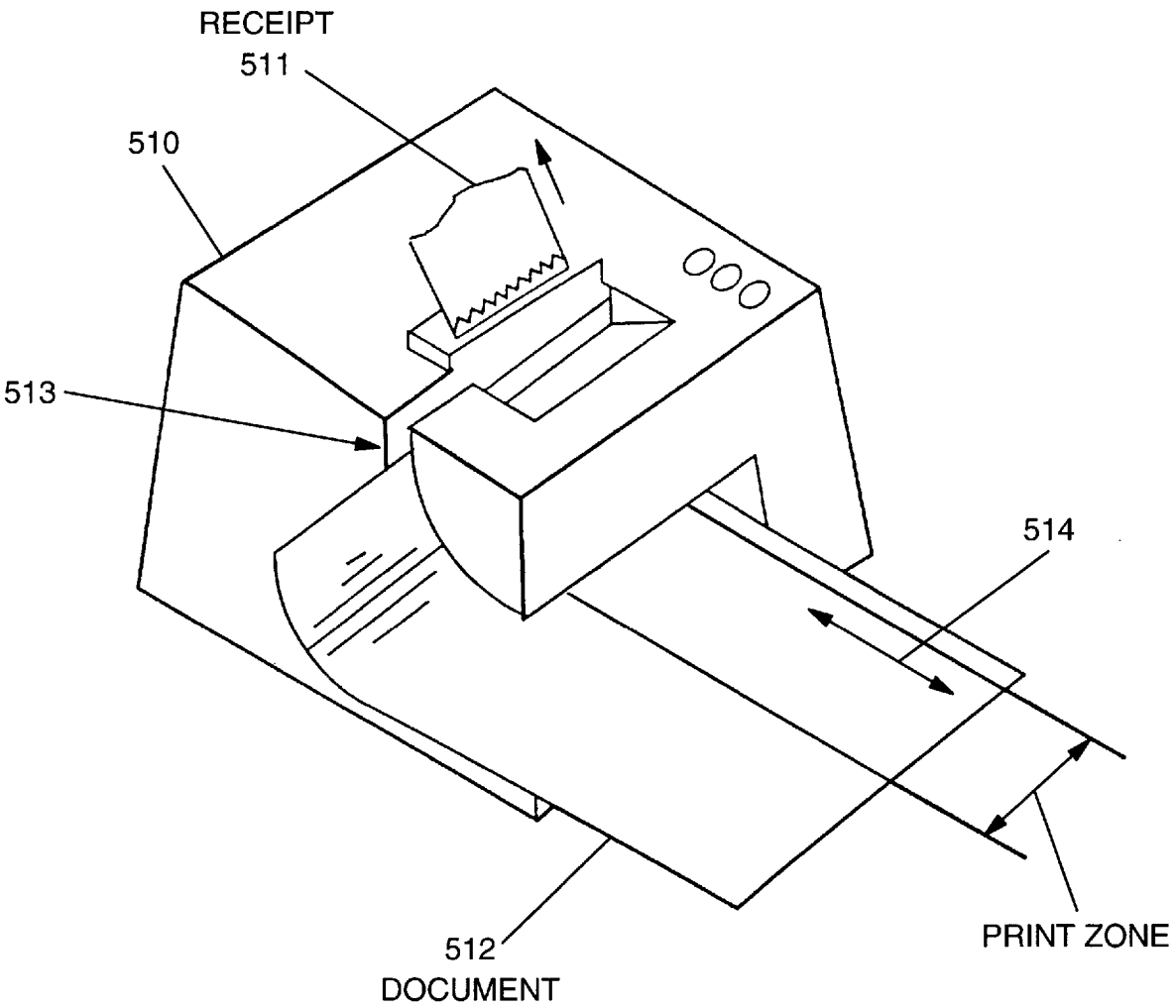
FIG. 5 illustrates a typical printer which implements the present invention.

Illustrated in FIG. 1 is a transport mechanism of a printer. A remaining portion of a printer should be well-known to one with skill in the art of printer mechanisms. However, a printer which may be used to implement the present invention is illustrated in FIG. 5.

Transport mechanism 100 of FIG. 1 comprises a platen 102, a print head 104, a print head carrier 106, a print head carrier post 108, a DI (document insert) feed roller 110, and a pressure roller 112. It should be noted that platen 102 and print head 104 are supported by a frame 114 and 116. Platen 102 is also rotatably coupled to frame 114 and 116. Print head 104 is coupled to print head carrier 106. Furthermore, print head 104 opposes platen 102 and may be moved along an axis which is parallel to a flat edge of platen 102. Pressure roller 112 is rotatably coupled to frame 114 and 116. In addition, pressure roller 112 is rotatably coupled about an approximately vertical axis with the right frame and slideably coupled to left frame 116. Print head carrier 106 is provided to support print head 104 and is substantially perpendicular to platen 102. A print head carrier post 108 is attached to a bottom side of print head carrier 106. Carrier post 108 abuts cam 208 when print head 104 is in the right position. It should be noted that in transport mechanism 100 of FIG. 1, additional elements are shown but not described in detail herein. It should further be observed that the use and implementation of such elements are well-known to those with skill in the art associated with printing mechanisms.

Figure 2:
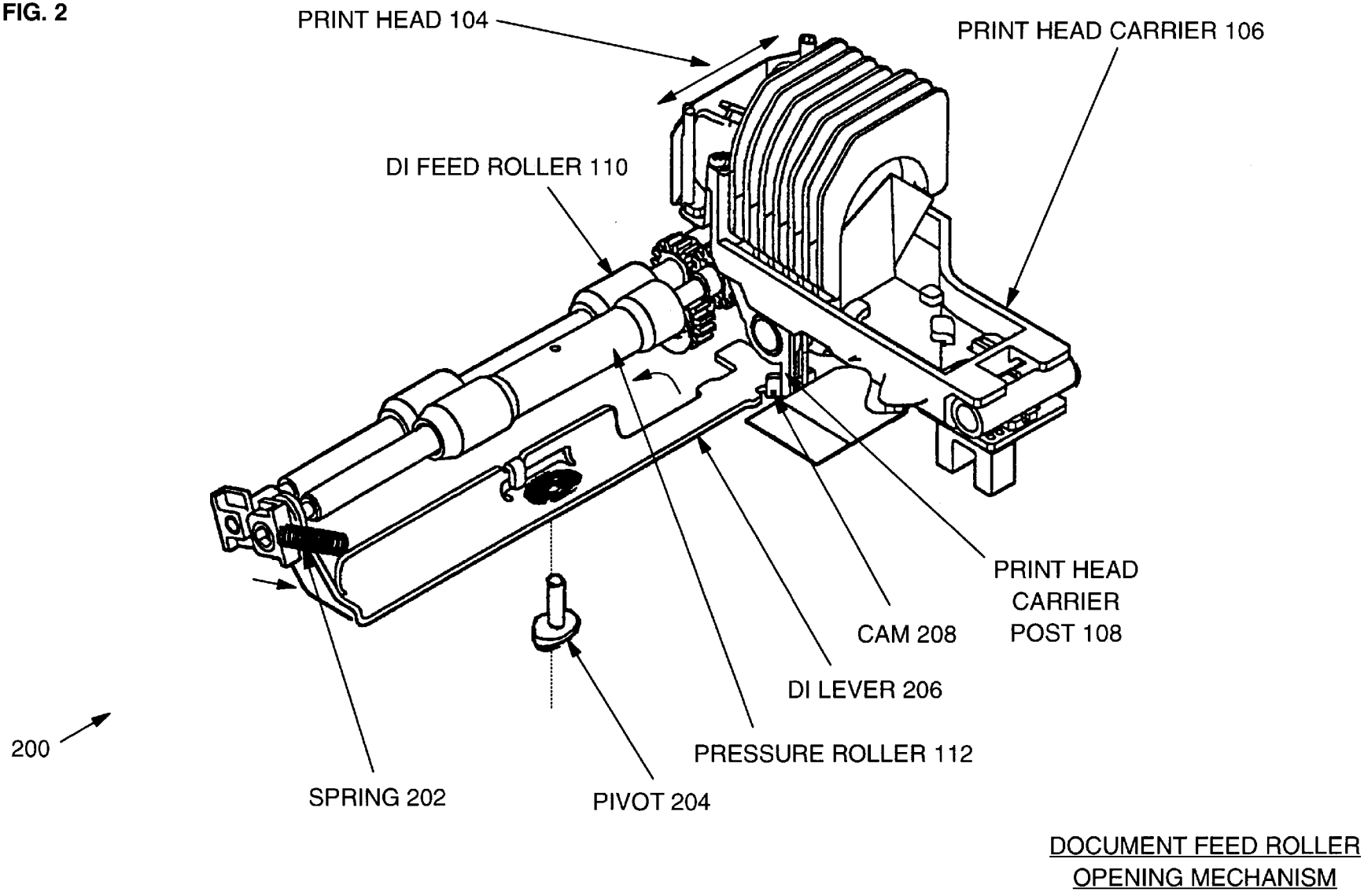
FIG. 2 illustrates a document feed roller opening mechanism of the transport mechanism of the printer of FIG. 1.

FIG. 2 illustrates a document feed roller opening mechanism of transport mechanism 100 in greater detail. Document feed roller opening mechanism 200 comprises print head 104, print head carrier 106, print head carrier post 108, DI feed roller 110, pressure roller 112, spring 202, pivot 204, DI lever 206, and cam 208. Print head carrier 106 supports print head 104. Together, print head 104 and print head carrier 106 move along an axis which is parallel to that formed by a flat edge of platen 102 (of FIG. 1). A rotational axis of DI feed roller 110 is collinear to carrier guide rod 118. It should be noted that guide rod 118 is not illustrated in FIG. 2 as to do so would conceal relevant portions of FIG. 2. However, carrier guide rod 118 is illustrated in greater detail in FIG. 1. Carrier guide rod 118 and document insert feed roller 110 are each coupled to frame 114 and 116. Similarly, pressure roller 112 abuts DI feed roller 110 and has a right end which is rotatably coupled to frame 114. A left end of pressure roller 112 and DI lever 206 are coupled to a first end of spring 202. A second end of spring 202 is coupled to a left side of frame 116. DI lever 206 is substantially parallel to each of DI feed roller 110 and pressure roller 112. Print head carrier post 108 is perpendicularly coupled to a bottom of print head carrier 106. Additionally, print head carrier post 108 abuts cam 208. DI lever 206 is rotatably coupled to frame 114 and 116 at pivot 204. Pivot 204 is provided to form a fulcrum-type pivot which allows DI lever 206 to rotate when carrier post 108 engages cam 208.

Figure 3:
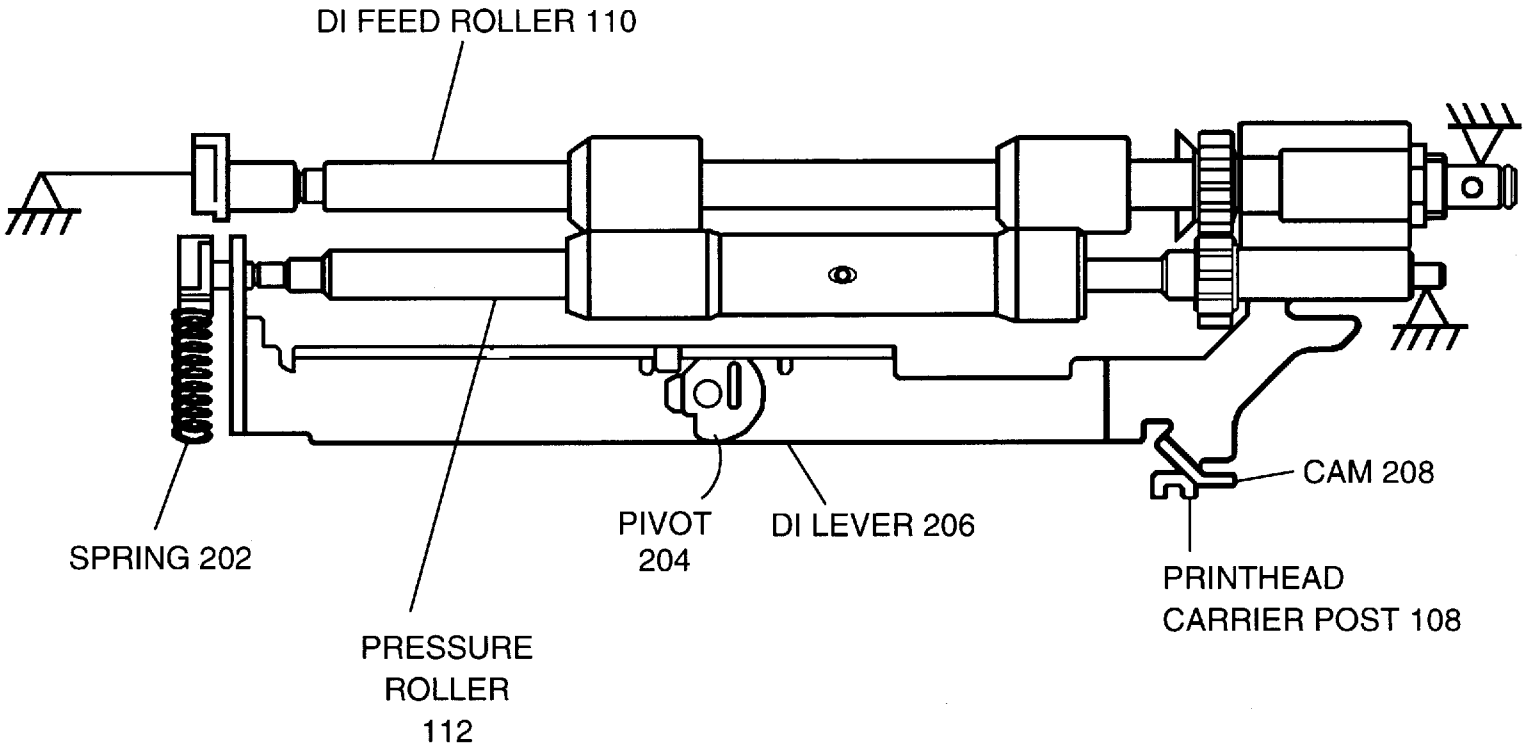
FIG. 3 illustrates a top view of the document feed roller opening mechanism of FIG. 2 in a closed position.
Figure 4:
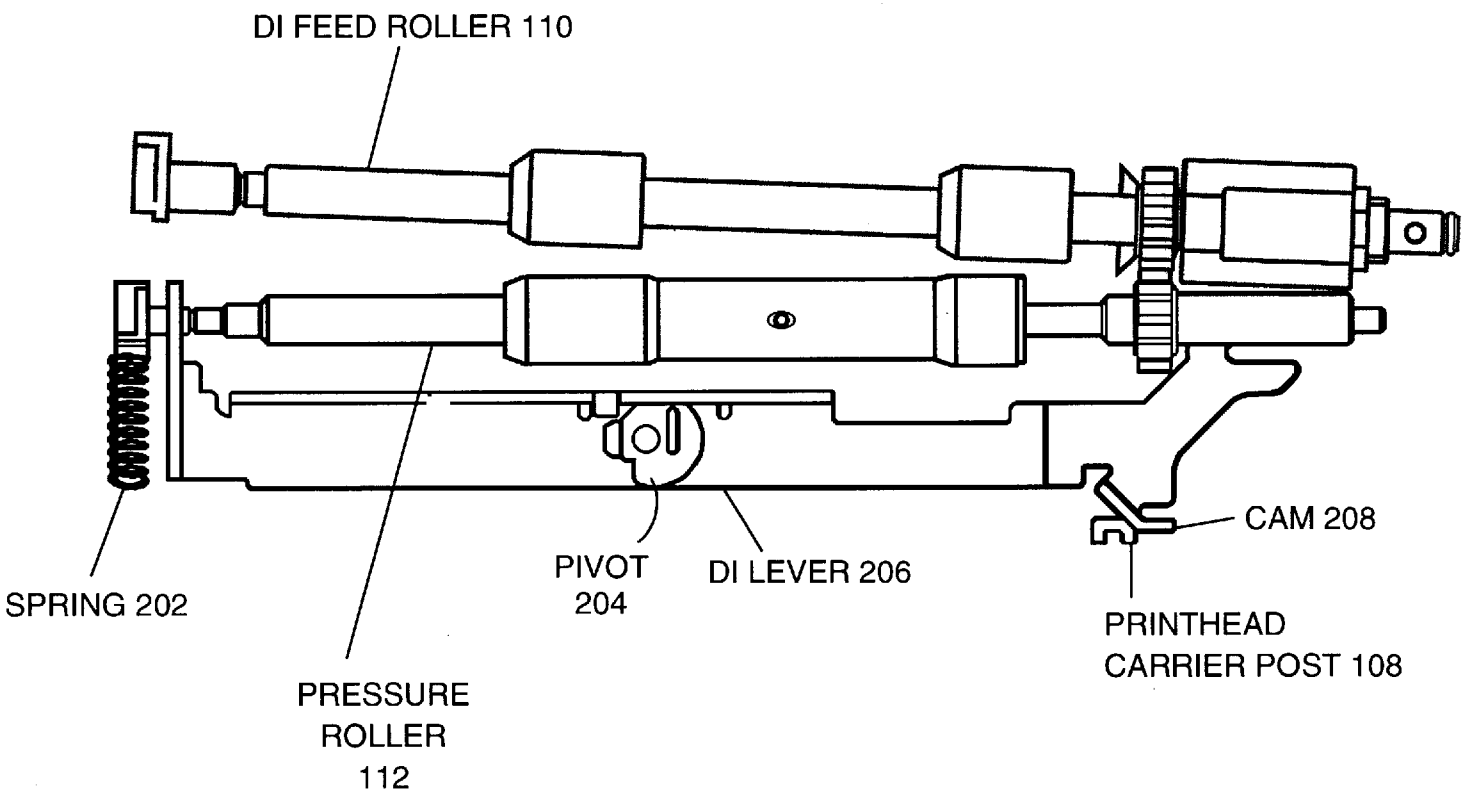
FIG. 4 illustrates a top view of the document feed roller opening mechanism of FIG. 2 in an open position.

FIG. 3 illustrates the document feed roller opening mechanism of transport mechanism 100 in a closed position from a top view. Similarly, FIG. 4 illustrates the document feed roller opening mechanism of transport mechanism 100 in an open position from a top view.

Operation of document feed roller opening mechanism 200 of transport mechanism 100 will subsequently be described in greater detail. Assume, during operation, that a user of the printer including transport mechanism 100 and document feed roller opening mechanism 200 of the present invention, desires to insert a document in a side opening of the printer. Such side openings are well-known in point of sale printers which commonly include such openings for the insertion of checks and other documents.

During operation, print head 104 is moved parallel to platen 102 through the movement of print head carrier 106. Print head carrier 106 moves along carrier guide rod 118 that allows print head carrier 106 to move from left to right. It should be noted that print head 104 is considered to be in a left position when it is in the position illustrated in FIG. 1. Additionally, when print head 104 is in the position illustrated in FIG. 2, it is considered to be in a right position. During operation, DI feed roller 110 and pressure roller 112 feed paper past print head 104 one line at a time. DI feed roller 110 and pressure roller 112 are driven by a circuit controlled motor which is not illustrated herein. The gears illustrated at the right ends of each of DI feed roller 110 and pressure roller 112 are included in the motor gear train. Furthermore, it should be noted that the cylindrical area between the two beveled areas of each of DI feed roller 110 and pressure roller 112 actually contact the paper. As is illustrated in FIG. 1, support for each DI feed roller 110 and pressure roller 112 is provided by a frame illustrated therein.

When print head carrier 106 and print head 104 are in a right position, print head carrier post 108 engages cam 208 and rotates DI lever 206 in a counter-clockwise direction about pivot 204. When DI lever 206 rotates in the counter-clockwise direction, spring 202 is compressed and a left end of pressure roller 112 is moved away from a left end of DI feed roller 110. It should be noted that right ends of each of pressure roller 112 and DI feed roller 110 remain substantially fixed in the frame 114 previously described.

FIG. 4 illustrates the open position of the document feed roller opening mechanism of the present invention. When the feed roller opening mechanism is in this position, paper may be easily slid between DI feed roller 110 and pressure roller 112.

Thus, through the use of simple sliding and rotating motions, document feed roller opening mechanism 200 provides a device and methodology for inserting a document in a side opening of a printer in an efficient and reliable manner. Furthermore, the device and methodology implemented by the present invention is less expensive than prior art implementations because only one lever, specifically DI lever 206, is required to engage cam 208 to separate DI feed roller 110 and pressure roller 112. The use of DI lever 206 only separates the left ends of DI feed roller 110 and pressure roller 112. However, the space between the two rollers is sufficient for inserting a document.

FIG. 5 illustrates a printer 510 which may be used to implement the present invention. Printer 510 has the capability of a standard single station printer which is able to print on a paper strip and a discrete medium. Printer 510 has a separate bidirectional document feed, as indicated by doubleheaded arrow 514 on document 512, and unidirectional receipt feed for receipt 511. Printing is performed on receipt 511 until document 512 is inserted into document slot 513. Printer 510 may be a point of sale printer located in proximity to a computerized "cash register" for printing receipts of sales as inputted into the cash register, or for printing documents such as checks or information on checks, such as illustrated in FIG. 5 by the insertion of document 512 into document slot 513.

The implementation of the invention described herein is provided by way of example only. However, many other implementations may exist for executing the function described herein.

While there have been described herein the principles of the invention, it is to be clearly understood to those skilled in the art that this description is made by way of example and not as a limited to the scope of the invention. Accordingly, it is intended, by the appended claims, to cover all modifications of the invention which fall within the true spirit and scope of the invention.

What is claimed is:

1. A document feed roller, comprising:

a print head carrier having a print head carrier post;

a document insert lever having a first end and a second end, the document insert lever having a cam at the second end, wherein the print head carrier post engages the cam to rotate the document insert lever in a first direction;

a device having a first end coupled to the first end of the document insert lever and a second end;

a document insert feed roller having a first end and a second end, the first end and the second end of the document insert feed roller being in a first fixed position;

a pressure roller having a first end and a second end, the first end of the pressure roller being in a second fixed position and the second end of the pressure roller being coupled to the second end of the device, the second end of the pressure roller being moved away the second end of the document insert feed roller when the print head carrier post engages the cam to rotate the document insert lever in the first direction.

2. The document feed roller of claim 1 wherein the first end of the pressure roller remains in the second fixed position when the second end of the pressure roller is moved away.

3. The document feed roller of claim 1 wherein the device comprises a spring.

4. The document feed roller of claim 1 wherein the print head carrier is positioned outside a normal print zone.

5. The document feed roller of claim 1 wherein the first end of the document insert feed roller and the first end of the pressure roller remain in relevant contact.

6. The document feed roller of claim 1 wherein the print head carrier post is located on an underside of the print head carrier.

7. The document feed roller of claim 1, further comprising:

a pivot perpendicularly coupled to the document insert lever.

8. The document feed roller of claim 7 wherein the document insert lever rotates perpendicularly to the pivot.

9. A method for opening a document feed roller, comprising the steps of:

providing a print head carrier having a print head carrier post;

engaging a cam at a second end of a document insert lever with the print head carrier post;

rotating the document insert lever in a first direction;

affixing a first end and a second end of a document insert feed roller in a first fixed position;

affixing a first end of a pressure roller in a second fixed position; and moving a second end of the pressure roller away from a second end of the document insert feed roller when the document insert lever is rotated in the first direction.

10. The method of claim 9 wherein the first end of the pressure roller remains in the second fixed position when the second end of the pressure roller is moved away.

11. The method of claim 9, further comprising the step of:

affixing a spring to the second end of the pressure roller and to the first end of the document insert lever.

12. The method of claim 11, further comprising the step of:

rotating the document insert lever to compress the spring.

13. The method of claim 9, further comprising the step of:

positioning the print head carrier outside a normal print zone.

14. The method of claim 9, further comprising the step of:

enabling the first end of the document insert feed roller and the first end of the pressure roller remain in relevant contact.

15. The method of claim 9, further comprising the steps of:

perpendicularly coupling a pivot to the document insert lever; and rotating the document insert lever perpendicularly to the pivot.

16. A printer, comprising:

a platen;

a print head carrier comprising a print head and a print head carrier post, wherein the print head carrier moves in parallel to the platen;

a document insert feed roller having a first end and a second end, the first end and the second end of the document insert feed roller being in a first fixed position;

a document insert lever having a first end and a second end, the document insert lever having a cam at the second end, wherein the print head carrier post engages the cam to rotate the document insert lever in a first direction;

a spring having a first end coupled to the first end of the document insert lever and a second end; and a pressure roller having a first end and a second end, the first end of the pressure roller being in a second fixed position and the second end of the pressure roller being coupled to the first end of the spring, the second end of the pressure roller being moved away from the second end of the document insert feed roller when the print head carrier post engages the cam to rotate the document insert lever in a first direction and the first end of the pressure roller remaining in the second fixed position when the second end of the pressure roller is moved away.

17. The printer of claim 16 wherein the print head carrier is positioned outside a normal print zone.

18. The printer of claim 16 wherein the first end of the document insert feed roller and the first end of the pressure roller remain in relevant contact.

19. The printer of claim 16 wherein the first direction is in a counter-clockwise direction.

20. The printer of claim 16 wherein a document is inserted between the document insert roller and the pressure roller when the second end of the pressure roller is moved away.

21. A document insert mechanism, comprising:

means for engaging a CAM at a second end of a document insert lever with a print head carrier post;

means for rotating the document lever in a first direction;

means for affixing a first end and a second end of a document insert feed roller in a first fixed position;

means for affixing a first end of a pressure roller in a second fixed position; and means for moving a second end of the pressure roller away from a second end of the document insert feed roller when the document insert lever is rotated in the first direction.

22. The document insert mechanism of claim 21 wherein the first end of the pressure roller remains in the second fixed position when the second end of the pressure roller is moved away.

* * * * *